United States Patent [19]

Lowenhaupt

[11] Patent Number: 4,861,371

[45] Date of Patent: Aug. 29, 1989

[54] NICKEL-CONTAINING LEACHATE HAVING LOW ALUMINUM CONTENT

[75] Inventor: Harris Lowenhaupt, Brookings, Oreg.

[73] Assignee: California Nickel Co., Crescent City, Calif.

[21] Appl. No.: 291,330

[22] Filed: Dec. 28, 1988

Related U.S. Application Data

[63] Continuation of Ser. No. 942,240, Dec. 16, 1986, abandoned.

[51] Int. Cl.[4] ..... C22B 23/04

[52] U.S. Cl. ..... 75/101 R; 75/2; 75/115; 75/119; 423/123; 423/128; 423/131; 423/140; 423/145; 423/146; 423/150

[58] Field of Search ..... 75/2, 101 R, 115, 119; 423/123, 128, 131, 140, 141, 145, 146, 150

[56] References Cited

U.S. PATENT DOCUMENTS

| | | | |
|---|---|---|---|
| 3,130,043 | 4/1964 | Lichty | 423/150 |
| 3,436,176 | 4/1969 | Spedden et al. | 423/119 |
| 3,798,304 | 3/1974 | Weston | 423/146 |
| 4,098,870 | 7/1978 | Fekete et al. | 423/150 |
| 4,195,065 | 3/1980 | Duyvesteyn | 423/150 |
| 4,415,542 | 11/1983 | Queneau et al. | 423/150 |
| 4,511,540 | 4/1985 | Crussard et al. | 423/150 |
| 4,541,868 | 9/1985 | Lowenhaupt | 75/101 R |

OTHER PUBLICATIONS

U.S. Bureau of Mines Publication RI 7162 by H. G. Iverson and H. Leitch, "Alumina Extraction by Autoclave Precipitation of Basic Sodium Aluminum Sulfate", Aug. 1968.

*Primary Examiner*—Robert L. Stoll
*Attorney, Agent, or Firm*—Gregory O. Garmong

[57] ABSTRACT

A nickel-containing ore is leached with sulfuric acid to dissolve nickel and associated metallic values into the sulfuric acid to form a leachate, the sulfuric acid further containing a source of the monovalent cations sodium, potassium or ammonium to suppress solubilization of aluminum ions in the ore. The leaching process is conducted at elevated temperatures of from about 200° C. to about 300° C., and at elevated pressures. In such leaching process, the monovalent cations are present in the leaching liquid prior to the initiation of leaching, to achieve an aluminum content of the leachate of less than about 0.5 grams per liter.

13 Claims, No Drawings

NICKEL-CONTAINING LEACHATE HAVING LOW ALUMINUM CONTENT

This application is a continuation of application Ser. No. 942,250, filed 12/16/86, now abandoned.

BACKGROUND OF THE INVENTION

This invention relates generally to the extractive metallurgy of ores, and, more associated values, especially cobalt and magnesium, from ores.

Metal values are often found in nature as compounds, present in small fractions in ores, mixed with a wide variety of impurities. To recover the metal values of interest for subsequent use, they must be removed from the ores and concentrated, refined and processed. The removal of the metal values from ores, termed extractive metallurgy, is desirable accomplished so that the metal values of interest are removed with great selectivity, as removal of impurities can greatly complicate the subsequent concentration and refinement procedures. Thus, extraction processes should be highly selective, so that only the metal values of interest are extracted from the ore, leaving behind the impurities in the residue to be discarded.

Nickel, a commercially significant metal, is found together with cobalt and other metals in a variety of types of nickel-bearing ores that are mined throughout the world. In one well established process, nickel and cobalt are extracted from an ore by mixing the ore with sulfuric acid to leach the nickel values into the sulfuric acid solution and form a leachate. Some cobalt and other metallic values such as magnesium are typically also dissolved into the leachate. The metallic values are then separated from the leachate by any of several processes, such as neutralization of the leachate with a base and precipitation of the nickel and cobalt values as hydroxides. The precipitated values are then gathered and refined into the respective metals.

The extraction process just described is typically carried out at elevated temperatures and pressures. The ore and sulfuric acid are introduced into an autoclave, which is heated to about 200° C. to about 300° C. and pressurized to about 200 to about 2000 pounds per square inch. These conditions promote the nickel extraction, as compared with leaching at ambient temperature and pressure. Because the nickel and cobalt are present in the ore in low concentrations such as a few percent by weight at most, large amounts of ore must be processed through autoclaves in this extraction process to obtain commercial quantities of nickel.

Ideally, the leaching process would attach and dissolve only the desired metal values into the leachate, but in practice the sulfuric acid also dissolves quantities of the impurities into the leachate. These impurities are then present in the leachate during subsequent steps, and either must be removed or tolerated during concentration and refining of the metal values.

Aluminum and iron are impurities found in many nickel-bearing ores, often in concentrations as great or greater than the desired nickel values. When the leachate is neutralized to precipitate the nickel values, the aluminum and iron impurities form precipitated hydroxides and basic sulfates that are gelatinous in nature, messy, and difficult to work with. Although high-temperature leaching tends to reduce the amount of the impurities coextracted with the nickel values, the precipitated impurities interfere with the removal of the precipitated nickel and cobalt values. It is not uncommon that the amount of undesired precipitated impurities is about as great as the amount of the desired nickel-containing precipitate, and the presence of the impurities can be a major obstacle to the complete recovery of the desirable metal values. As an example, in one Indonesian lateritic ore the nickel content is about 1.6 percent, and the aluminum content about 1.4 percent.

Selection of the proper leaching conditions can reduce the amount of extracted aluminum impurities. A number of other techniques have been developed for minimizing the amount of the extracted impurities, and some of these techniques are applied during the extraction operation. Unfortunately, there are side effects of some of the techniques that are worse than the problem partially solved by their use. Other techniques are effective in avoiding iron or aluminum in the leachate, or controlling their presence and harmful effects, but are expensive to use in large-scale operations or have limited utility when both aluminum and iron are present. For example ferric iron can be removed from aqueous solution by precipitation at atmospheric pressure and near-boiling temperature as crystalline jarosite, but the presence of aluminum complicates the process as it cannot be removed as crystalline alunite at atmospheric pressure. Aluminum can be removed as alunite in a second leaching step at lower temperatures than used in the nickel leaching, but requires the use of expensive equipment to withstand the pressure and corrosive conditions of the process.

Experience has shown that the aluminum content of the leachate must be reduced below about 0.5 grams per liter to avoid the problems associated with its presence. If the aluminum is present in greater amounts, there must be a separate, costly treatment of the leachate to reduce the aluminum to levels acceptable in subsequent operations. On the other hand, if the aluminum content is below about 0.5 grams per liter, its presence is tolerable in subsequent operations. Thus, the aluminum impurity level of about 0.5 grams per liter is critical, in that the presence of larger amounts of aluminum require costly additional processing steps to reduce the aluminum content to less than that level.

There therefore exists a need for a process for extracting nickel values from nickel-bearing ores having aluminum impurity, wherein the presence of aluminum is reduced to a level of less than about 0.5 grams per liter in the leachate. Such a process must be inexpensive to use and desirably would be fully compatible with the presently used high-pressure leaching of the nickel-bearing ore with sulfuric acid. The present invention fulfills this need, and further provides related advantages.

SUMMARY OF THE INVENTION

The present invention resides in a process for extracting nickel values from nickel containing ores, wherein the presence of aluminum impurities in the leachate is suppressed to a level below about 0.5 grams per liter. The process of the invention is fully compatible with the established high-temperature leaching process, requiring no hardware modifications or investment. Reduction of the aluminum impurities to a level of less than about 0.5 grams per liter in the leachate greatly simplifies subsequent processing by avoiding the gelatinous aluminum precipitate that would otherwise be mixed with the precipitate containing the nickel values. The approach of the invention does not introduce any significant complications or side effects into the subsequent recovery of the nickel values. Other impurities such as iron can be subsequently removed from the leachate by known processing.

In accordance with the invention, a process for preparing a leachate having therein nickel values and a low content of aluminum, comprises the steps of forming a mixture of a nickel-bearing ore which also contains aluminum as an impurity, sulfuric acid, and an effective amount of a soluble source of a monovalent cation; heating the mixture to an elevated temperature of from about 200° C. to about 300° C., under pressure, to leach the nickel values from the ore into the liquid portion of the mixture, thereby forming a liquid leachate containing nickel values and an aluminum content of less than about 0.5 grams per liter, the source of monovalent cations being added to the mixture no later than the beginning of the leaching.

The addition of a source of a monovalent cation, or mixtures thereof, to the sulfuric acid/ore mixture in an amount of, preferably, about 10 to about 100 kilograms per metric ton of ore is found to suppress the dissolution of aluminum impurity from the ore into the leachate to a level below about 0.5 grams per liter. The source of the cation must be present in an effective amount sufficient to reduce the aluminum content of the leachate to less than about 0.5 grams per liter, and this effective amount can vary depending upon the fraction of the cation in the source of the cation, the ore, and the leaching conditions. The effective amount required for any particular ore and leaching conditions can be determined in the manner illustrated subsequently, see particularly Example 2.

The cation is preferably selected from the group consisting of lithium, sodium, potassium, rubidium, cesium, and ammonium ions. The source of the cation is preferably a sulfate, oxide, chloride, or silicate, most preferably a sulfate because of the low cost of common sulfates of monovalent ions. There is no known limitation on the source of the monovalent cations, other than it being soluble in the aqueous sulfuric acid leachant. Preferred sources include ammonium sulfate, sodium sulfate, sodium silicate, potassium chloride, cesium chloride, rubidium chloride, ammonium chloride, sodium chloride, potassium sulfate, and lithium sulfate.

The source of the monovalent cation is provided in the leachant mixture generally concurrently with, or prior to, the initiation of the elevated temperature, elevated pressure leaching. A substantial delay in providing the monovalent cations in the leaching mixture reduces the effectiveness of suppression of the aluminum in the leachate, and in general will not permit suppression of the aluminum content to a level below about 0.5 grams per liter when the process is applied to conventional aluminum-containing ores.

It will now be appreciated that the present invention provides an improvement in the art of extracting nickel values from ores. Extraction of aluminum impurities is suppressed to less than about 0.5 grams per liter in the sulfuric acid leachate, which avoids the need for other, more expensive methods of dealing with the presence of the aluminum in the leachate. Other features and advantages of the present invention will be apparent from the following more detailed description of the preferred embodiment, which description illustrates, by way of example, the principles of the invention.

DETAILED DESCRIPTION OF THE PREFERRED EMBODIMENT

In a preferred embodiment of the invention, soluble source of a monovalent cation is mixed with a nickel-bearing ore having aluminum as an impurity, and sulfuric acid. The mixture, which contains both liquid and solid components, is introduced into a pressure vessel whose contents can be heated under pressure. Such pressure vessels, known as autoclaves, are commonly available in industrial and research sizes.

The mixture is reacted for a period of time at elevated temperature and pressure, causing the nickel, cobalt, and related values to leach out of the ore and into the sulfuric acid, which then is known as the leachate. In a typical leach process, a mixture of ore, sulfuric acid, and source of monovalent cation is heated at a temperature of from about 200° C. to about 300° C. at a pressure of from about 200 psi to about 2000 psi, for a period of time of from about 30 minutes to 2 hours. Preferred reaction conditions are a temperature of 240° C. and a pressure of 500 psig, for 60 minutes.

Upon completion of this leaching treatment, the liquid leachate is separated from the reacted solids, which are discarded or further processed to recover other values. The leachate is treated to separate the nickel and cobalt values, as by neutralizing the leachate with an hydroxide to precipitate the nickel and cobalt values as hydroxides. Other impurities that have been coextracted with the nickel, such as iron, can also separated in this processing of the leachate.

The presence of the monovalent cations suppresses the extraction of the aluminum impurity. That is, the aluminum is not appreciably dissolved from the ore into the leachate. While not wishing to be bound by this possible explanation, it is believed that the monovalent cations aid in forming solid compounds of aluminum that are resistant to dissolution in the leachate. Specifically, it is believed that alunites or related compounds are formed to tie up the aluminum in an insoluble, crystalline basic sulfate that remains with and in the leach residue. Such alunites generally have the formula $MAl_3(SO_4)_2(OH)_6$, where M is a monovalent cation. The addition of a sufficient quantity of monovalent cations to the leachant is therefore though to supply an excess of M ions for reaction to form the alunite.

In practicing the invention, it is important that the monovalent cations be present during the initiation of the leaching operation for maximum effectiveness. That is, the source of monovalent cations preferably is mixed with the ore and sulfuric acid prior to introduction of the mixture into the autoclave. The source can also be introduced as the autoclave is being heated or pressurized, or at about the time the leaching reaction starts. The source of monovalent cations should, however, not be introduced into the leachant at a time substantially after the initiation of the leaching, or the effectiveness of the monovalent cation in suppressing aluminum dissolution into the leachate will be reduced, until it is not possible to maintain the level of aluminum in the leachate below about 0.5 grams per liter. Experience has shown that the addition of the source of monovalent cation should not be delayed until the leaching process is half over, as too much aluminum is dissolved into the leachate by this point, and its extraction cannot be suppressed.

Within the limitations set forth herein, there appear to be no limitations on the type of monovalent cation used, or the source of the monovalent cations. Based upon the results of the examples and other experiments conducted upon this process, it is thought that equivalent suppression of aluminum is attained when the same molar amounts of monovalent cations, or mixtures thereof, are supplied in the leachate.

The following examples are provided to illustrate aspects of the invention, and are not to be taken as limiting of the scope of the invention in any respect.

EXAMPLES 1–12

A series of samples of about 10 pounds each of Indonesian laterite ore having approximately 1.6 percent nickel, 0.10 percent cobalt, and 1.4 percent aluminum were introduced into an autoclave of capacity 13 U.S. gallons. About 4 pounds of sulfuric acid of about 66 Baume was also introduced. A source of monovalent cations, of the type and amount set forth in the following Table 1, was mixed with the ore and sulfuric acid. The autoclave was then closed and the contents were heated to 240° C. and the saturation pressure of about 500 pounds per square inch gauge (psig), to begin the leaching treatment. The leaching continued for 60 minutes. Upon completion of the leaching treatment, the liquid leachate was removed and analyzed to determine the nickel-to-aluminum ratio, aluminum content in grams per liter, nickel content, cobalt content, and residual acid level of the leachate. The values of the additive used and its amount in kilograms per metric ton (kg/T), ratio of Ni:Al in the leachate, content of aluminum in the leachate in grams per liter (gpl), and the percentage of extraction of nickel and cobalt are reported in the following Table 1.

TABLE 1

| Example | Additive/ Amount | Ni:Al ratio | Al gpl | Residual Acid, gpl | Extraction % Ni | Extraction % Co |
|---|---|---|---|---|---|---|
| 1 | none | 1.1 | 3.8 | 57 | 96 | 94 |
| 2 | $(NH_4)_2SO_4$ 50 kg/T | 18.4 | 0.47 | 63 | 97 | 94 |
| 3 | $(NH_4)_2SO_4$ 50 kg/T | 43.8 | 0.16 | 33 | 94 | 97 |
| 4 | $(NH_4)_2SO_4$ 50 kg/T | 56.3 | 0.14 | 34 | 93 | 95 |
| 5 | $(NH_4)_2SO_4$ 25 kg/T | 25.0 | 0.30 | 57 | 95 | 94 |
| 6 | $(NH_4)_2SO_4$ 25 kg/T | 31.5 | 0.23 | 42 | 90 | 88 |
| 7 | $(NH_4)_2SO_4$ 20 kg/T | 56.2 | 0.16 | 50 | 95 | 94 |
| 8 | $(NH_4)_2SO_4$ 10 kg/T | 16.9 | 0.32 | 36 | 96 | 95 |
| 9 | $(NH_4)_2SO_4$ 10 kg/T | 15.3 | 0.46 | 37 | 96 | 95 |
| 10 | $(NH_4)_2SO_4$ 10 kg/T | 17.7 | 0.43 | 36 | 96 | 94 |
| 11 | none | 3.2 | 2.43 | 66 | 97 | 94 |
| 12 | none | 7.2 | 0.86 | 40 | 94 | 93 |

From Table 1, it is apparent that the addition of the monovalent cation significantly increases the ratio of nickel to aluminum in the leachate and reduces the absolute aluminum level in the leachate to less than about 0.5 grams per liter, while not adversely affecting the extraction of nickel and cobalt. This level of aluminum in the leachate is acceptably low for subsequent processing, By contrast, when no monovalent cation is added, the aluminum content is well above about 0.5 grams per liter, which would result in unacceptably high levels of gelatinous aluminum precipitate in subsequent processing.

EXAMPLES 13–28

Examples 1–12 were repeated, except that the ore was a Philippine laterite ore having about 1.8 percent nickel, 0.10 percent cobalt, and 1.0 percent aluminum. The apparatus and leaching procedures were otherwise identical to those of Examples 1–12. The results of these tests are set forth in the following Table 2.

TABLE 2

| Example | Additive/ Amount | Ni:Al ratio | Al gpl | Residual Acid, gpl | Extraction % Ni | Extraction % Co |
|---|---|---|---|---|---|---|
| 13 | $Na_2SO_4$ 12.5 kg/T | 32.1 | 0.21 | 32 | 96 | 94 |
| 14 | none | 7.2 | 1.05 | 52 | 96 | 92 |
| 15 | $Na_2SO_4$ 12.5 kg/T | 22.6 | 0.38 | 44 | 96 | 94 |
| 16 | $Na_2SO_4$ 12.5 kg/T | 21.8 | 0.31 | 29 | 93 | 88 |
| 17 | $(NH_4)_2SO_4$ 12.5 kg/T | 16.0 | 0.28 | 34 | 91 | 88 |
| 18 | $(NH_4)_2SO_4$ 12.5 kg/T | 12.8 | 0.43 | 41 | 94 | 90 |
| 19 | $(NH_4)_2SO_4$ 20 kg/T | 15.5 | 0.35 | 38 | 94 | 92 |
| 20 | $(NH_4)_2SO_4$ 80 kg/T | 24.0 | 0.22 | 36 | 94 | 93 |
| 21 | $(NH_4)_2SO_4$ 80 kg/T | 13.9 | 0.35 | 38 | 90 | 90 |
| 22 | $(NH_4)_2SO_4$ 20 kg/T | 12.8 | 0.37 | 45 | 96 | 92 |
| 23 | none | 5.3 | 0.78 | 41 | 94 | 92 |
| 24 | $(NH_4)_2SO_4$ 10 kg/T | 13.8 | 0.37 | 37 | 91 | 92 |
| 25 | $(NH_4)_2SO_4$ 10 kg/T | 10.6 | 0.53 | 51 | 95 | 88 |
| 26 | $Na_2SiO_3$ 37 kg/T | 21.9 | 0.38 | 54 | 96 | 92 |
| 27 | none | 4.8 | 1.12 | 46 | 92 | 81 |
| 28 | none | 4.6 | 1.33 | 56 | 94 | 90 |

The results for the Philippine laterite ore are generally the same as for the Indonesian ore of Examples 1–12. As shown in Examples 17–22 and 24–25, for the case of the source of the cation being ammonium sulfate, reduction of the amount of the cation- containing salt below about 10 kg/T results in an aluminum content of the leachate that approaches an unacceptably high level. Thus, the cation must be added in an effective amount, which for the Philippine ore is about 10 kg/T of ammonium sulfate. The numerical value of the required effective amount of monovalent cation can vary for different cation sources, ores and leaching treatments, but can be readily determined by a series of experiments of the type illustrated by these Examples. In such a procedure, a series of leaching treatments using different levels of a particular source of monovalent cation are conducted, and the resulting leachate studied to determine whether it is acceptable for further treatment to separate the nickel values. In commercial practice, a study of this type is performed to determine the effective amount of the cation addition required to achieve a desirably low level of aluminum, below about 0.5 grams per liter, so that uneconomically higher additions of the cation are not used.

EXAMPLES 29–41

A California laterite having about 0.75 percent nickel, 0.11 percent cobalt, and 4.4 percent aluminum was leached in a 300 milliliter capacity laboratory autoclave, containing 50 grams of ore, 100 milliliters of water, and about 30 grams of sulfuric acid. The leaching procedures were otherwise identical to those of Examples 1–12. The results of these tests are set forth in the following Table 3.

TABLE 3

| Example | Additive/ Amount | Ni:Al ratio | Al gpl | Residual Acid, gpl | Extraction % Ni | Extraction % Co |
|---|---|---|---|---|---|---|
| 29 | KCl 52 kg/T | 8.2 | 0.32 | 74 | 98 | 96 |
| 30 | KCl 52 kg/T | 16.5 | 0.16 | 46 | 98 | 96 |
| 31 | none | 2.0 | 0.82 | 31 | 92 | 94 |
| 32 | none | 1.1 | 2.4 | 43 | 95 | 95 |
| 33 | KCl 52 kg/T | 50.7 | 0.06 | 26 | 96 | 97 |
| 34 | CsCl 52 kg/T | 13.5 | 0.16 | 35 | 96 | 96 |
| 35 | RbCl 86 kg/T | 9.9 | 0.21 | 26 | 98 | 97 |
| 36 | KCl 52 kg/T | 41.6 | 0.05 | 16 | 98 | 96 |
| 37 | KCl 52 kg/T | 18.5 | 0.16 | 36 | 98 | 97 |
| 38 | NaCl 40 kg/T | 13.0 | 0.24 | 26 | 96 | 96 |
| 39 | $NH_4Cl$ 40 kg/T | 5.7 | 0.46 | 28 | 96 | 96 |
| 40 | $(NH_4)_2SO_4$ 46 kg/T | 6.5 | 0.42 | 26 | 97 | 95 |
| 41 | $Na_2SO_4$ 50 kg/T | 8.3 | 0.30 | 37 | 97 | 96 |

Collectively, these examples demonstrate that the process of the invention is highly effective in suppressing the aluminum content of the leachate, thereby reducing the amount of aluminum that would otherwise be precipitated during separation of the nickel and cobalt values.

Thus, the present invention provides a process for preparing a leachate containing nickel values but also having a reduced level of aluminum. The reduced aluminum content results in greatly simplified subsequent procedures for recovering the nickel values. Although particular embodiments of the invention have been described in detail for purposes of illustration, various modifications may be made without departing from the spirit and scope of the invention. Accordingly, the invention is not to be limited except as by the appended claims.

What is claimed is:

1. A process for preparing a leachate, comprising the steps of:

forming a mixture of a nickel-bearing ore which also contains aluminum as an impurity, sulfuric acid, and a source of a monovalent cation which is soluble in the sulfuric acid; and heating the mixture to an elevated temperature of from about 200° C. to about 300° C., under pressure, to leach the nickel values from the ore into the liquid portion of the mixture, thereby forming a liquid leachate containing nickel values, the source of monovalent cations being added to the mixture no later than the beginning of the leaching and in an amount sufficient to suppress the dissolution of the aluminum impurity so that the aluminum content of the leachate is less than about 0.5 grams per liter.

2. The process of claim 1, wherein the amount of the source of a monovalent cation is from about 10 to about 100 kilograms per metric ton of ore.

3. The process of claim 1, wherein the amount of the source of a monovalent cation is from about 10 to about 50 kilograms per metric ton of ore.

4. The process of claim 1, wherein the nickel-bearing ore is a laterite.

5. The process of claim 1, wherein the monovalent cation is selected from the group consisting of lithium, sodium, potassium, rubidium, cesium, and ammonium ions, and mixtures thereof.

6. The process of claim 1, wherein the monovalent cation is provided in the form of a salt selected from the group consisting of sulfates, oxides, chlorides, and silicates of the monovalent cation, and mixtures thereof.

7. The process of claim 1, wherein the monovalent cation is provided in the form of a sulfate of the monovalent cation.

8. The process of claim 1, wherein the source of the monovalent cation is selected from the group consisting of ammonium sulfate, sodium sulfate, sodium silicate, potassium chloride, cesium chloride, rubidium chloride, ammonium chloride, sodium chloride, potassium sulfate, and lithium sulfate, and mixtures thereof.

9. A process for preparing a leachate, comprising the steps of:

forming a mixture of a nickel-bearing ore which also contains aluminum as an impurity, sulfuric acid, and a source of a monovalent cation which is soluble in the sulfuric acid, in an amount of from about 10 to about 100 kilograms per metric ton of ore, the soluble source being a salt selected from the group consisting of sulfates, oxides, chlorides, and silicates, and mixtures thereof, of a cation selected from the group consisting of lithium, sodium, potassium, rubidium, cesium, and ammonium ions, and mixtures thereof; and heating the mixture to an elevated temperature of from about 200° C. to about 300° C., at a pressure of from about 200 psig to about 2000 psig, to leach the nickel values from the ore into the liquid portion of the mixture, thereby forming a liquid leachate containing nickel values and an aluminum content of less than about 0.5 grams per liter, the source of monovalent cations being added to the mixture prior to said step of heating.

10. A process for preparing a leachate, comprising the steps of:

forming a mixture of a nickel-bearing ore which also contains aluminum as an impurity, sulfuric acid, and an effective amount of a monovalent cation to suppress dissolution of aluminum into the leachate; and heating the mixture to an elevated temperature of from about 200° C. to about 300° C., under pressure, to leach the nickel values from the ore into the liquid portion of the mixture, thereby forming a liquid leachate containing nickel values and an aluminum content of less than about 0.5 grams per liter.

11. The process of claim 10, wherein the monovalent cation is selected from the group consisting of lithium, sodium, potassium, rubidium, cesium, ammonium, and mixtures thereof.

12. The process of claim 10, wherein the monovalent cation is supplied as a salt of an anion selected from the group consisting of sulfates, oxides, chlorides, silicates, and mixtures thereof.

13. The process of claim 10, wherein the monovalent cation is supplied in a salt selected from the group consisting of ammonium sulfate, sodium sulfate, sodium silicate, potassium chloride, cesium chloride, rubidium chloride, ammonium chloride, sodium chloride, potassium sulfate, and lithium sulfate, and mixtures thereof.

* * * * *